US005443211A

United States Patent [19]

Young et al.

[11] Patent Number: 5,443,211

[45] Date of Patent: Aug. 22, 1995

[54] SPRAY MACHINE FOR GIVING A TEXTURE TO DRYWALL

[75] Inventors: Lesley Young, Belton, Mo.; Brian D. Rhodes, Olathe; Gary Acton, Kansas City, both of Kans.; Michael L. Oglesby, Lee's Summit, Mo.; Michael L. Fureigh, Shawnee Mission, Kans.

[73] Assignee: The Stanley Works, New Brittain, Conn.

[21] Appl. No.: 147,383

[22] Filed: Oct. 26, 1993

Related U.S. Application Data

[63] Continuation-in-part of Ser. No. 828,387, Jan. 30, 1992, abandoned.

[51] Int. Cl.[6] ..... B05B 7/02; B05B 7/14; B05B 7/24

[52] U.S. Cl. ..... 239/146; 239/379; 239/532; 239/578; 239/581.1

[58] Field of Search ..... 239/146, 302, 379, 390, 239/526, 532, 578, 581.1, 654

[56] References Cited

U.S. PATENT DOCUMENTS

| | | | |
|---|---|---|---|
| 1,605,185 | 11/1926 | Heinrich | 239/532 X |
| 2,808,048 | 10/1957 | Garrson | 239/146 X |
| 2,820,672 | 1/1958 | Arce et al. | 239/379 X |
| 3,322,350 | 5/1967 | Heinicke et al. | 239/578 |
| 3,542,250 | 11/1970 | McRitchie | 239/654 |
| 3,861,599 | 1/1975 | Waggoner | 239/654 |
| 3,878,815 | 4/1975 | Gorius | 239/654 X |
| 3,891,149 | 6/1975 | Rendemonti | 239/526 X |
| 3,896,998 | 7/1975 | Vertue | 239/654 X |
| 4,364,521 | 12/1982 | Stankowitz | 239/391 X |
| 4,588,318 | 5/1986 | O'Brien et al. | 239/578 X |
| 4,621,770 | 11/1986 | Sayen | 239/526 X |
| 4,850,536 | 7/1989 | Teranishi et al. | 239/526 X |
| 4,863,104 | 9/1990 | Masterson | 239/390 X |

FOREIGN PATENT DOCUMENTS

| | | | |
|---|---|---|---|
| 2575939 | 7/1986 | France | 239/302 |
| 835511 | 6/1981 | U.S.S.R. | 239/146 |

*Primary Examiner*—Andres Kashnikow
*Assistant Examiner*—Lesley D. Morris
*Attorney, Agent, or Firm*—Laff, Whitesel, Conte & Saret, Ltd.

[57] ABSTRACT

A portable wall and ceiling texture machine applicator is housed in a relatively small cabinet mounted on relatively large rear wheels for easy pulling up stairs and on swivel front casters for easy steering. A first material delivery system includes a variable speed pump which delivers particulate texture material at a selected flow rate which enables a creative application of texture. A completely separate delivery system delivers pressurized air to a spray head which merges the particulate texture material and pressurized air to spray it onto a wall or ceiling. Separate power cords supply energy for delivering the particulate texture material and pressurized air so that existing 15-amp house supply circuits may be used. The spray head may be on either a pole gun or a hand gun. A check valve on the spray head prevents a back flow of the particulate material when the spray head is turned off.

16 Claims, 6 Drawing Sheets

SPRAY MACHINE FOR GIVING A TEXTURE TO DRYWALL

This is a continuation-in-part application to Ser. No. 07/282,387, filed Jan. 30, 1992, now abandoned.

This invention relates to equipment for installing texture particulate material on ceilings and walls and more particularly to tools for giving a texture, especially—but not exclusively—to drywall.

For convenience of expression, the terms "particulate texture material" or "texturing material" will be used herein to describe any suitable materials which may be used to apply a textured coat to walls or ceilings. Many people who work in the field refer to this material as "mud." Examples of such particulate materials are plaster, cement, or the like. Another material is a lightweight material designed to acoustically treat a surface to make a quieter room. A machine for spraying particulate texture material has the power to deliver the lightweight acoustic material; however, a machine for spraying acoustic material does not usually have the power to deliver the heavier particulate texture material.

For centuries, buildings have had plaster walls, many of which were textured, so that currently, many people who want a traditional appearance in their buildings have textured walls. The traditional plaster walls may be textured by using any of many different techniques, working the surface while the plaster is still wet. However, by now, drywall construction has supplanted much—if not most—of the plaster walls that were used heretofore. Drywall comprises relatively large panels of plaster, or the like, with cardboard bonded onto opposite sides of the panel.

Usually, the drywall is painted after it is installed, which gives an appearance that is practically indistinguishable from a painted plaster wall. If a separate texture coat is applied before such textured walls are painted, they have a distinctive surface appearance ranging from a stippling to a coarse hill and dale effect, in many different patterns.

Prior labor intensive techniques have been used to texture the drywall through the use of various manual processes. However, these processes have been slow and have produced operator fatigue. Usually, these processes have involved working with rollers which have to be pressed against the wall while heavy, hard to work particulate materials are distributed with a surface pattern. As a result of this prior history of texturing ceiling and wall surfaces, there are now many surface effects that people recognize, such as those effects which are now known as: acoustic, spray splatter, knockdown splatter, or orange peel. Since texturing is now, in essence, practically an art form or at least a skilled craft, these effects may vary greatly from job to job; nevertheless, anyone who is familiar with texturing walls or ceilings is able to readily identify the patterns. For example, each of the "orange peel" surfaces prepared by different people might look quite different, if placed side by side. However, all of those who are skilled in the art will easily agree that each has an "orange peel" surface.

Hence, if new and novel means for and method of texturing surfaces is provided, they should include a way for the workman to express his "artistry" by making an individualized surface while preserving his ability to produce recognized patterns.

While the foregoing comments have been limited to a discussion of plastered walls, by way of example, the invention is also applicable to other textured wall surfaces, such as cement and stucco, for example.

In the prior art, truck-mounted equipment has sometimes been used to provide some of these features, but portable equipment is often preferred. For example, the workman may have to transport it to a second or third story in a house with no elevator. When the user is a single workman who is alone on a job site, it is easy to see that he cannot lift a heavy machine to an upper floor. Thus, smallness and portability becomes an important factor. However, it is not easy to scale down truck-mounted equipment in order to provide portable equipment.

When one stops to understand that a particulate texture material applicator machine of the described type is working with wet plaster or cement, the need for easy and complete cleanup becomes apparent. This heavy particulate texture material includes water, and its oxidizing effect, together with the corrosive effect of the particulate material, causes a hopper, wall, or tank holding the plaster or cement to rust or corrode. Thus, making a hopper of fiberglass or another strong, lightweight, easily cleaned material is not just an option; it-may be a difference between the commercial success and failure of the texture applicator machine.

An operator who is spraying ceiling and wall textures must apply a fairly thick, heavy level of textured material which has a thick body. Insofar as the textural material is concerned, the failure to spray the heavy material with sufficient force produces three problems. First, the final product on the wall does not present a desired appearance. Either it is not adequately uniform, or it has the "look" of a lightweight coverage. Second, the operator usually has to work at such close distances that he must wear stilts and do other awkward things in order to apply any fairly acceptable surface. Third, the operator does not have the flexibility required to produce exactly the surface effect that he wants to produce.

A second consideration involves the applicator machine itself. If there is an inadequate delivery of the particulate texture material by the machine, the material tends to plug up in a hose or spray head, or the machine otherwise fails to deliver the proper amount of material at the proper pressure. For example, there can be a build-up of texture material within the material delivery system, especially when the spraying pauses or stops. Thus, when the machine is again turned on, a pressure surge occurs to cause a blob or blobs of the material to splatter out of the spray head. As a result, the operator may have to keep available a special bucket which he uses to receive the initial spray after the end of a pause or after a switched-off condition. This use of a bucket to collect the initial material delivery wastes texture material and increases the clean-up cost, tiring the operator who has to carry off the bucket of wasted material.

One should also distinguish between spraying a heavy particulate texture material, of the type which is usually called "mud", and spraying a lightweight acoustic material. The "mud" is a heavy mixture which is intended to give an appearance of a construction type of material, such as plaster, concrete, or the like, for example. The acoustic material is a lightweight substance primarily intended to make a room quieter without making an unduly noticeable surface appearance. These two types of materials often entail the use of different applicator machines.

Yet another consideration relates to the remote control of spraying carried out from the spray gun, as compared to control from the applicator machine. If the operator can turn the machine off and on remotely, it greatly reduces the probability that there will be surges expelling blobs of material. On the other hand, the electrical controls on the spray gun are difficult to provide, since they are subjected to rather severe mechanical stress and problems. These which might occur because the particulate texture material may leak, the operator may have the texture material on his hands, he may have to hold the spray gun in an awkward position to reach certain surfaces, or he may have trouble manipulating all of the equipment, such as hoses, pole, etc. while pushing buttons, turning knobs, etc.

Yet another consideration is how far the spray gun may be moved from the applicator machine and still remain operative. If the machine is able to successfully deliver heavy "mud" through a fifty-foot hose, there is no need to move the applicator machine while covering walls and ceilings in many houses. In one case, it was found that with a fifty-foot hose, an operator could cover a four-bedroom house with a two-car garage in only three hours. If the application machine was only able to deliver the heavy particulate texture material through a much shorter base, it is conceivable that spraying the textured material over the same house might have required much more than the three hours, due to the additional time in moving the machinery and the supply of texturing material, cleaning up, etc.

Accordingly, an object of this invention is to provide new and improved means for and methods of applying a great variety of textures to ceiling and wall surfaces, especially to drywall. Here, an object is to provide a faster, less fatiguing way to apply such textures to surfaces in a great variety of different patterns. In particular, an object is to give a workman artistic freedom to apply a texture of his individual design while enabling him to produce known surface patterns.

Another object of the invention is to better simulate known textures which are applied to plaster walls, without requiring substantial labor. In particular, an object is to accomplish this end without requiring an undue number of accessories.

Another object is to provide these objects with easily portable equipment. Here, an object is to provide an applicator machine which is light and easily portable and yet is able to reliably deliver heavy, mud-like texturing material through long hoses to a spray head. In this connection, an object is to remotely control the applicator machine from a spray head at the end of a long hose.

Yet another object of the invention is to provide an applicator machine which does not produce pressure surges and unwanted blobs or splattering.

In keeping with an aspect of the invention, these and other objects are accomplished by a machine which is built to spray most construction coatings, with a heavy aggregate laden particulate texture material that is small enough to pass through one of the orifices at the far end of a pole gun. The gun sprays mill mixes, acoustics, drywall mud, and waterproofing plus many other forms of particulate materials. This machine has a first material delivery system with a variable speed pump driven by a first electric motor, to propel the heavy particulate texture material through a hose to a first spray head. A second and separate delivery system with a compressor driven by a second motor delivers air through a completely separate hose to the spray head, where the air system merges with the particulate texture material delivery system in the spray head. The two delivery systems are completely separate so that if necessary, they may be run off completely separated fused electrical circuits, which may eliminate the need to run a special power line to drive the applicator machine. The spray head delivers material in a wide variety of patterns, ranging from fine wall textures to heavy "ceiling acoustic" splatter.

A preferred embodiment of the invention is seen in the attached drawings, wherein.

Figure 1:
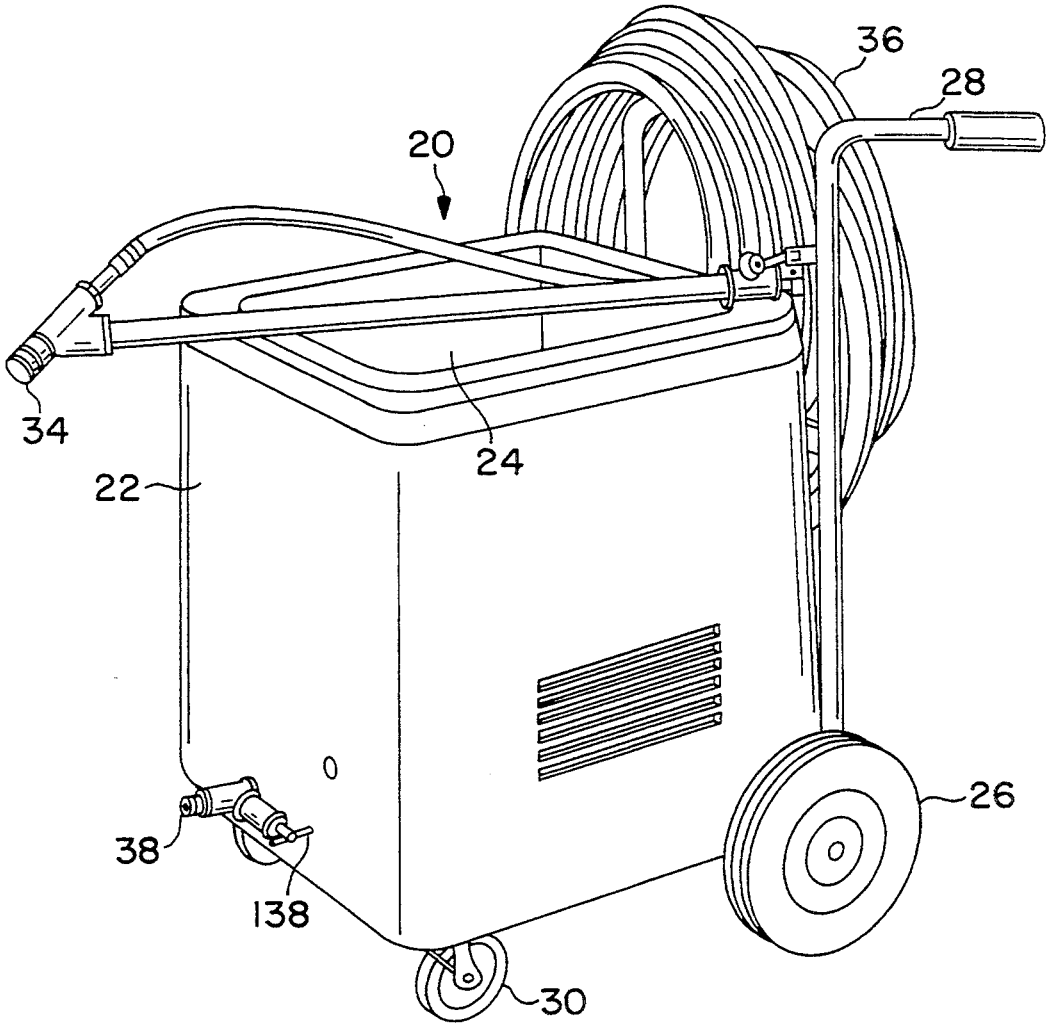
FIG. 1 is a perspective view of the inventive machine.
Figure 2:
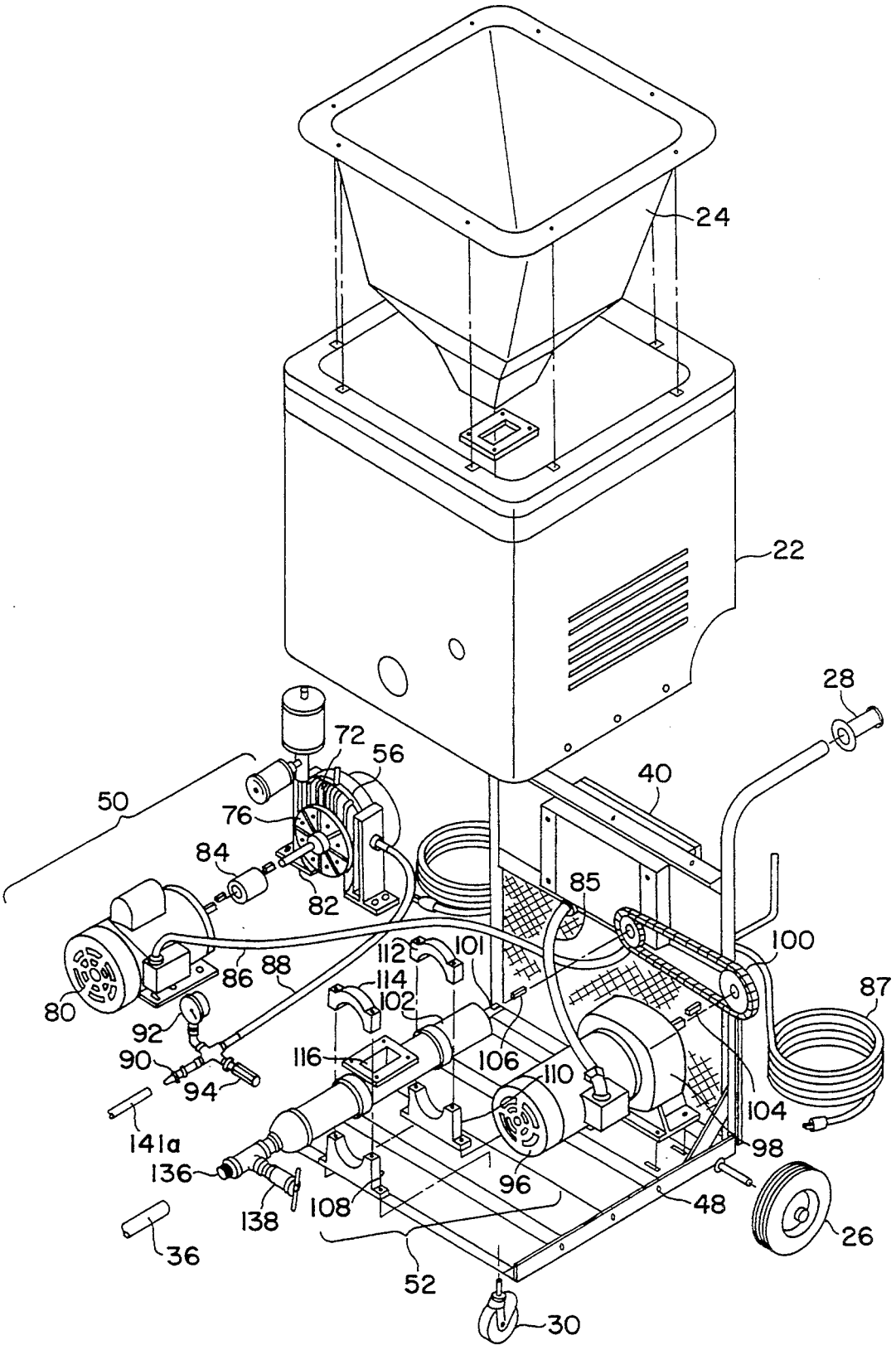
FIG. 2 is an exploded view of the inventive machine.

The inventive texture applicator machine 20 is seen in FIGS. 1 and 2 as including a housing 22 made of any suitable material and containing a hopper 24 made of a suitable non-rusting, non-corroding material, such as fiberglass, for example. Since a light weight is desirable for portability, the entire housing may also be made of fiberglass. A pair of fairly large wheels 26 support one end of the machine so that it may be pulled up a flight of stairs by manipulating suitable handles 28 which are located over the large wheels. The opposite end of the machine is supported by swivel casters 30 for easy steering.

A pole gun 34 is connected to the machine via a suitable particulate texture material hose 36 which is connected to the output nipple 38. The workman may apply the particulate texture material to a ceiling or wall by simply holding the pole gun near it and operating controls on either the machine or pole gun.

Figure 3:
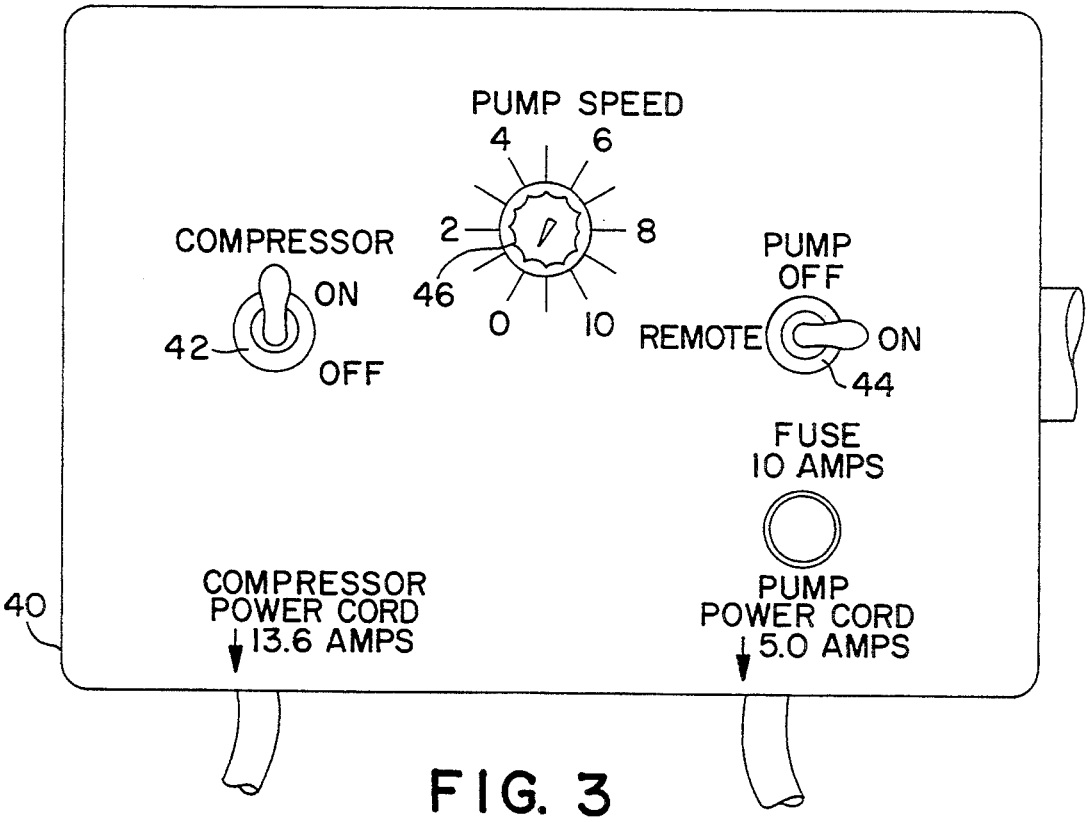
FIG. 3 is a plan view of a control panel on the inventive machine.

Mounted on the machine 20 are a first set of controls 40 (FIG. 3). A set of remote controls is mounted on the pole gun or hand gun. A compressor may be switched ON/OFF at 42 in order to supply pressurized air. At 44, the pump for the particulate texture material may be switched ON/OFF or switched to remote in order to transfer the controls to the pole gun. A suitable rotary control knob 46 may drive the pump at any one of a suitable variety of speeds.

The assembly of the texture applicator machine is best seen in the exploded view of FIG. 2.

Figure 4:
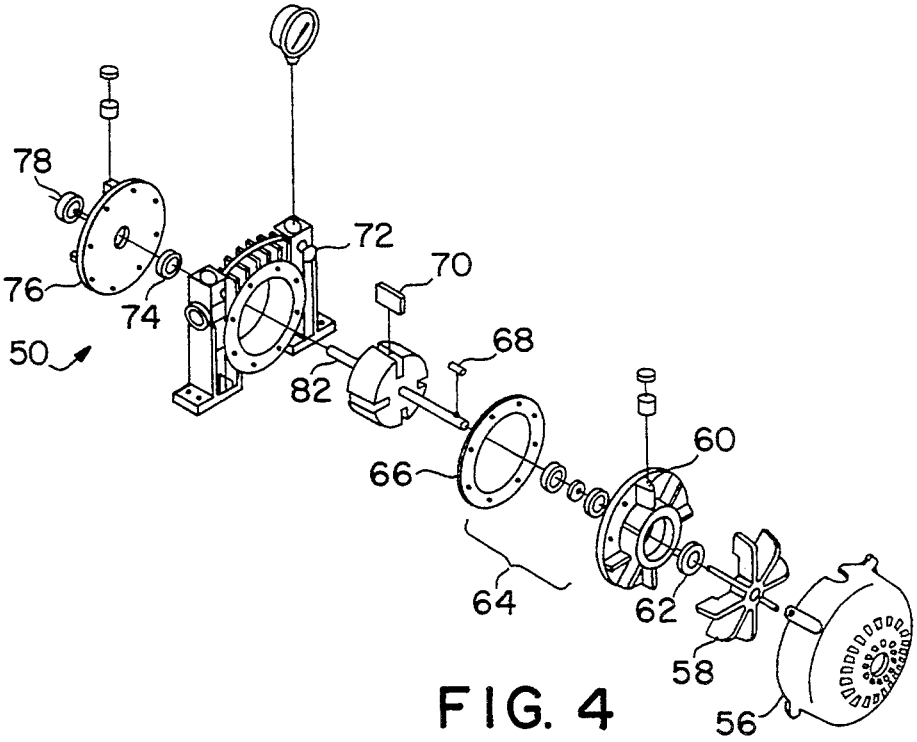
FIG. 4 is an exploded view of a compressor for the inventive machine.

An important aspect of the invention is that two completely separate systems are provided for delivering air and texturing material to the pole gun. This way both the air and the texturing material may be controlled independently of each other. A suitable frame 48 supports the parts of the machine. A first major assembly is a motor driven air compressor 50 and a second major, and completely separate, assembly is a motor driven, particulate material pump 52. The compressor assembly 50 (FIG. 4) comprises a compressor 56, bearing and support 58, a lubricant fitting 60, retain rings and grease seals 62, 64, gasket 66, shaft key 68, compressor rotor and vane 70, compressor body 72, bearing 74, end plate 76, and seal 78. These parts are assembled and mounted on frame 48 (FIG. 2). A first electric motor 80 is also mounted on the frame, in line with the compressor 56, and joined to compressor shaft 82 by coupler 84. Compressed air is delivered by an air hose 88 to an end fitting 90. The end fitting 90 and hose are designed to have the same, relatively large (such as one-half inch) diameter so that air flows to the pole gun without turbulence. The air pressure is displayed on a suitable gauge 92. A relief valve 94 may be operated to control or eliminate pressure in the air hose 88.

The particulate material pump 52 comprises a second motor 96, preferably a D.C. gear motor (FIG. 2), driving through gear box 98 which is connected via a chain drive 100 to a pump 102. The chain drive 100 is suitably connected to the gear box shaft by key 104 and to shaft 101 of the pump 102 by key 106. The pump is attached to the frame 48 by stator/cradle members 108, 110. An upper stator/cradle clamp 112, 114 bolts onto cradle member 108, 110 to secure pump 102 in place. The bottom outlet of hopper 24 is connected to pump 102 at its input 116.

The compressor motor 80 is electrically connected to control box 40 by a first power cord 86. The pump motor 96 is connected to control box 40 by a second power cord 85. If desired, the control box may be connected to a suitable power outlet by a single power cord 87, but that might require a heavy amp or higher voltage circuit which is not always available in a house in some foreign countries. However, the two separate power cords 85, 86 from the pump and compressor may be plugged into separately fused 15-amp wall outlets. In many operations, this use of two 15-amp circuits avoids the need to string a special power line in order to use the texture applicator machine. This feature is of particular importance in some countries having power distribution systems which are not capable of driving a heavier duty motor which might be required if a single-motor power cord is used.

Figure 5:
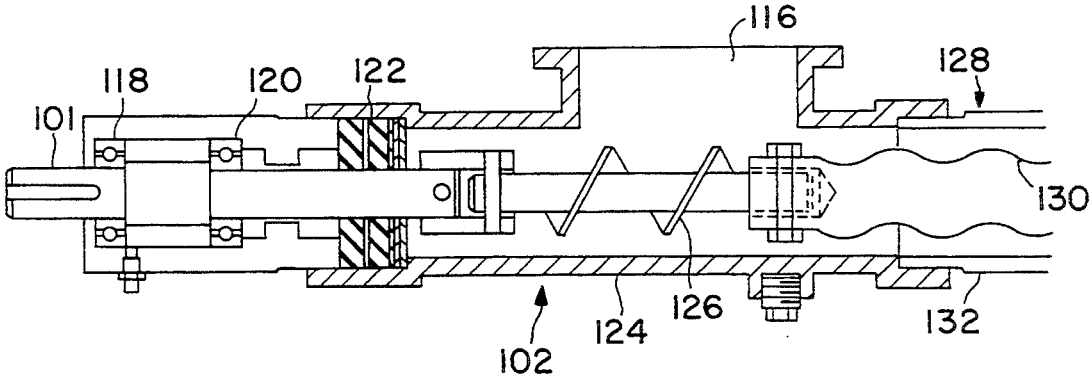
FIG. 5 is a cross-section view of a pump assembly for delivering the particulate material.

The details of the particulate texture material pump 102 are shown in FIG. 5. The input shaft is mounted on bearings 118, 120. A suitable seal assembly 122 seals one end of the compartment 124 which receives the particulate texture material. An auger 126 transports the particulate texture material to an outlet 128 on the right, as viewed in FIG. 5. In the outlet area 128, a central worm drive member or rotor 130 rotates to move the particulate texture material in a rightward direction between it and stator 132. The pumped particulate texture material exits at 136 (FIG. 2), to a hose 36 (FIG. 2), connected to nipple fitting 136. A material relief valve 138 may be set to open under a selected pressure of material. The hose and fittings preferably have a uniform diameter which are selected to provide an unrestrained and free flow of the material to the pole gun.

Figure 6:
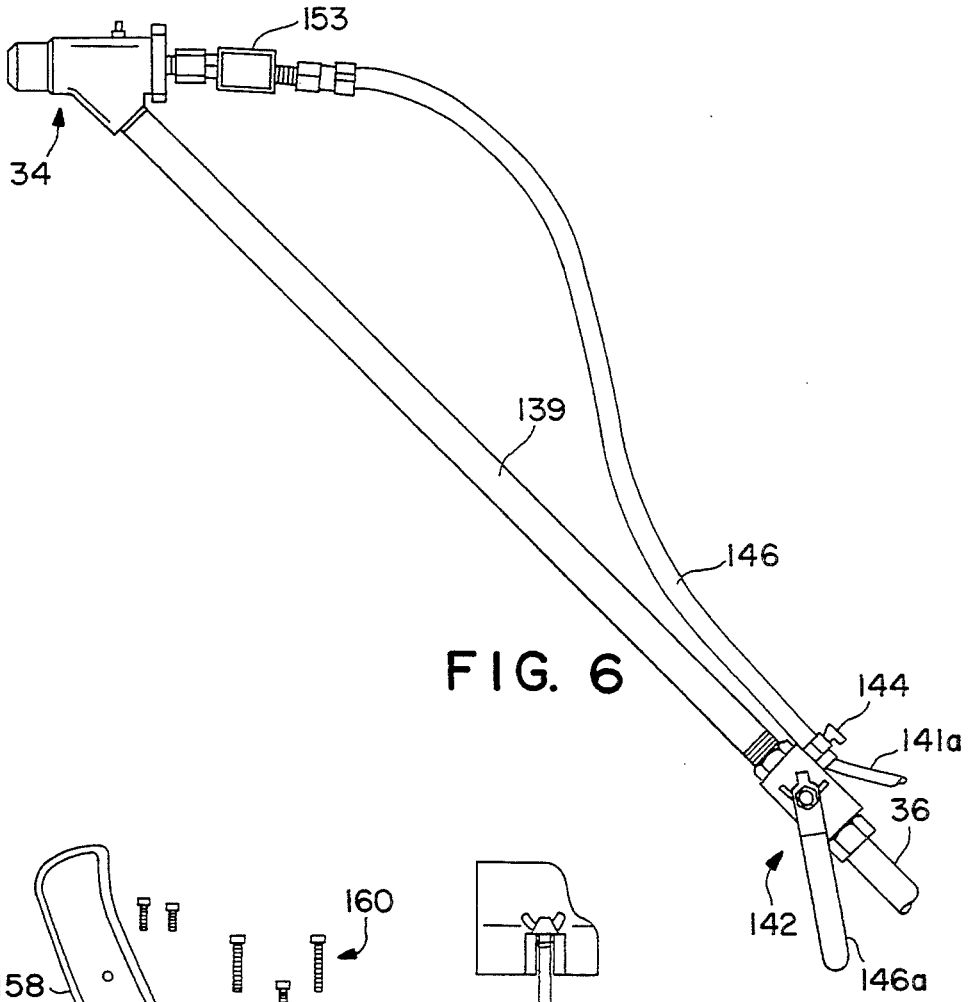
FIG. 6 is a side elevation of the pole gun and an exploded view of an air valve and controls therefor.

The details of pole gun 34 are seen in FIG. 6. A control assembly 142 opens and closes paths from the hose 36 through which the particulate texture material moves from the pump 102 to the material tube 139 of the spray gun 34 and air hose 141*a*. The rest of the path to the output end of gun 34 is completed via particulate material tube 139. An air hose 146 feeds compressed air from air line 141*a* to the gun 34.

The operator's remote control assembly 142 (FIG. 8) provides separate controls over tile separate flows of both the heavy particulate texture material and compressed air. From an air hose 141*a* extending back to the texture applicator machine (FIG. 1), the compressed air enters the operator remote control assembly 142 via an air ball valve 143. The valve should open and close with a quarter turn rotation of a handle 144 which opens a passageway formed by a hole which aligns with the passage. The hole and the passageway should have substantially the same diameters so that air flows smoothly and without turbulence or reflection. When the handle 144 is turned back a quarter turn, the valve rotates so that the hole through it is transverse to the passageway and a solid side of the valve blocks the passageway for pressurized air.

The particulate texture material also travels from the applicator machine through a hose 36 (FIGS. 1, 6) to a ball valve 145 (FIG. 8) controlled by a turn of a handle 146*a*. As with the pressurized air delivery system, the ball in valve 145 for the textured material delivery system has a bore with the same diameter as the inside diameter of hose 36 and material tube 139 (FIG. 6) so that the heavy particulate texture material flows smoothly and without turbulence.

An electrical switch 149 is operated or released by a push button 150. The switch and push button may be covered in whole or in part by a suitable elastomer boot which keeps foreign material out of the switch mechanism. The boot is flexible enough not to interfere with push button operation. An electrical power cord 151 extends from switch 149 to connector 152, to which any suitable power line may be connected for extending a circuit back to operate the applicator machine.

A bracket member 147*a* receives U-bolts 147*b*, 148 which secure the particulate texture material ball valve 145, air ball valve 143, and an electrical switch 149 in place and relative to each other.

When the parts are so secured to the bracket 147*a* , the push button 150 lies in the path followed by handle 146*a* on the particulate texture material ball valve 145. Thus, when handle 146*a* is moved to a position which opens the ball valve 145 to deliver the material, push button 150 is pushed by the handle to close switch 149 and start the particulate material pump 52 (FIG. 2). When the handle 146*a* is moved to a position which closes the valve 145, the push button 150 is released to open the switch 149 and turn off the particulate material pump 52.

One problem is that as the compressed air is switched off, the particulate texture material could force itself back into the air hose 141 before the pressure of the particulate texture material subsides in material tube 139. Therefore, a check valve 153 is provided in hose 141 to prevent a backward flow while allowing a forward flow of pressurized air.

The pressurized air and particulate texture material delivery systems are completely separate, beginning with the two motors 80, 96 and extending over hoses 141*a*, 36 to remote controls 142, material tube 139, air hose 146, and check valve 153 to spray gun head 34 where the delivery systems merge to spray the particulate materials onto the walls or ceilings.

Thus, to spray the heavy particulate texture material, the operator first opens the compressed air valve 143. Then, holding the material tube 139 (FIG. 7) in one hand and its control handle 146*a* in the other hand, the operator modulates the flow of the particulate texture material out the spray gun head 34 by opening and closing ball valve 145 (FIG. 8).

A hand gun (FIG. 7) may be provided to reach places which are in restricted or other areas where the pole gun would be awkward to use. The principal parts of the hand gun are left and right housings 156, 158 which may be secured together by means of bolts 160. An electric switch 162 may be placed in the housing 156 with a control button which projects out a slot 163 in order to turn the pump 102 (FIG. 2) on and off responsive to thumb pressure applied by the person holding the hand gun of FIG. 7. A trigger assembly 164 drops onto the housing to open a valve and deliver pressurized air. Thus, one would squeeze the trigger 164 with his fingers while pressing the electrical switch 162 with his thumb in order to deliver a compressed air driven spray of particulate texture material.

The particulate texture material delivery system begins at inlet 166 and exits at an orifice plate 168 connected to the outlet 170 of the gun. Plate 168 is secured to the gun by bolts 172 which fit into slots 174.

The air supply is delivered via air line 141*a* through an end fitting 176 connected to a rear bushing 178. A seal and washer combination 180 provides a seal at the pressurized air entrance to the gun. Spring 182 biases the trigger 164 to a normally closed position, where no air is delivered. An air stem pipe 184 carries the air from rear bushing 178 to a front bushing 186 where a "Neoprene" seal 188 joins it to a selected one of many alternative orifices 190, 192.

Figure 7:
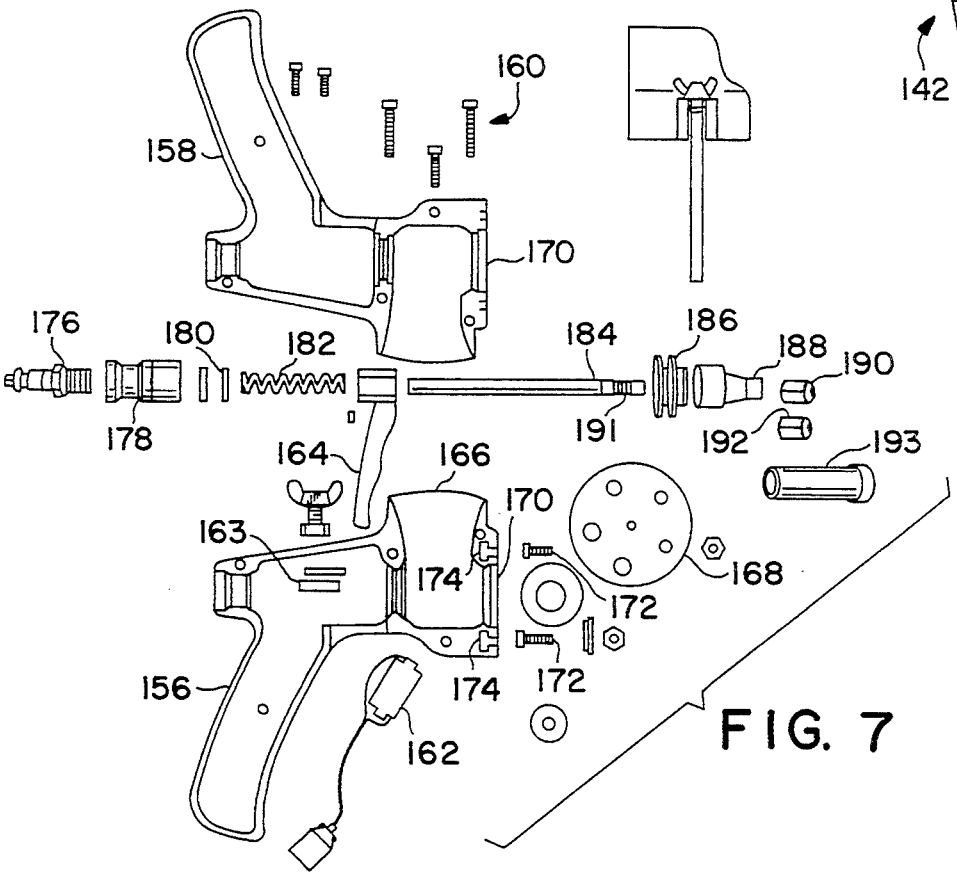
FIG. 7 is an exploded view of an alternative hand spray gun.
Figure 8:
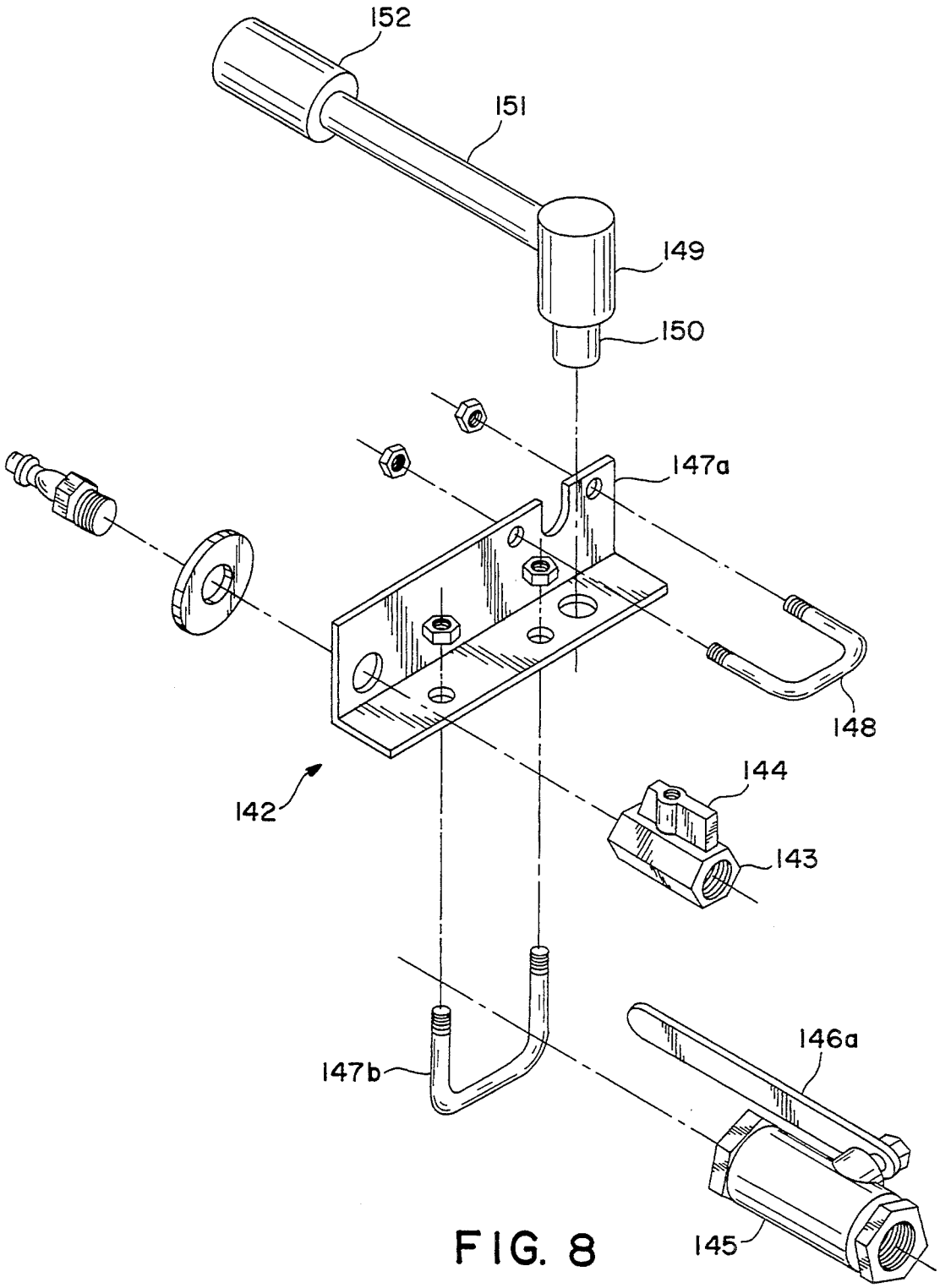
FIG. 8 is an exploded view of a pole gun remote control device.

Each of the guns shown in FIGS. 6, 7 has mean for adjusting a distance between the air stem and the nozzle tip. This means is most apparent in FIG. 7, where the air stem 184 has a threaded end 191 which receives a selected one of the air orifice nozzle tips 190, 192. The distance between the air stem and nozzle tip is adjusted by turning the tip 190, 192 more or less further onto the end of the air stem. To facilitate making this adjustment, an air stem socket tool 193 is supplied with the gun. This socket is inserted into an end of the gun, over the orifice tip, and then turned.

In operation, all of the appropriate parts are first connected together. Then, three to four gallons of soapy water are placed in the tank or hopper 24 (FIG. 2). The soapy water is run through the pump 102 and hose 36 to help free the rotor 130 (FIG. 5) and to lubricate the particulate texture material line. This soapy water procedure should be repeated for each operation or if the pump has sat idle for a period of time. After all of the soapy water has been pumped out of the hopper 24, the pump is turned off, and the particulate texture material is added into hopper 24. The particulate texture material line should always be wet before pumping in order to minimize friction.

The pump 102 can be operated manually from the OFF/ON switch 44 (FIG. 3) located on the control box 40. When the switch 44 is in the "ON" position, the valve on the gun should be "OPEN" to prevent a pressure build-up in the particulate texture material line. The OFF/ON switch 44 is preferably connected to over-ride the switch at 149 (FIG. 8) on the pole gun (FIG. 6). If the switch 44 is set to "remote", the operator is able to turn the pump on and off from the pole gun. With the switch 44 in the "remote" position, an opening of the particulate texture material valve 145 (FIG. 8) and, therefore, operation of switch 149 automatically turns the pump on and closing it automatically shuts off the pump. If the hand gun is used, the same control is carried out by pushing or releasing a button on switch 162, which is on the left side of the gun.

The pump speed is varied by adjusting a "Pump Speed" control 46 (FIG. 3) located on control box 40. The control positions are number 0–10, with "0" being no flow and "10" being maximum flow at 2 GPM. The speed control dial is set on "0" when pump 102 is started in order to avoid damage to the pump assembly.

The machine is now ready to spray the particulate texture material. In order to use the machine, it is essential to obtain a proper mix. When mixing drywall acoustic and wall texture, it is best to make the mix a little stiffer.

Pattern adjustments of the texture formed by the particulate texture material, when sprayed on a ceiling or wall, are determined by three factors: (1) air supply; (2) particulate texture material orifice size; and (3) particulate texture material flow. All three factors must be considered when selecting or adjusting a pattern of texture.

The air supply is adjusted by reading air pressure meter 92 (FIG. 2) while adjusting the relief valve 94. After a desired air pressure is obtained, a locking nut is tightened.

Each gun has at least four nozzle tips (⅜", 5/16", ¼" 3/16"). The particular tip that is selected depends to a large extent on the size of the aggregate in the particulate texture material that is being used. The tip must be large enough to allow the aggregate to flow freely. Tip size also affects the coarseness or fineness of the pattern. The larger the tip, the more coarse the pattern. When spraying acoustic particulate texture material, ⅜" or 5/16" tips are the most popular. To obtain a very fine wall spray such as an orange peel texture, the 3/16" or ¼" tip should be used. If there is a straight stream of particulate texture material, the air stem and air pressure should be adjusted until the straight stream disappears, thus leaving a uniform round spray.

By using the pump speed control 46 (FIG. 3) the flow rate of the particulate texture material can be varied. The greater the particulate texture material flow rate, the more coarse the texture pattern. The following chart is a rough guide showing how the various factors combine to produce different spray patterns.

| Pattern | Nozzle Tip Orifice Size | Air Volume | Range Of Distance Between Air Stem And Nozzle Tip | Particulate Texture Material Volume |
|---|---|---|---|---|
| Acoustic | ⅜" | Med-High | ⅜"–½" | Med-High |
| Acoustic | 5/16" | Med-High | ⅜"–½" | Med-High |
| Fog | 3/16" | High | 1/16" | Low |
| Orange Peel | ¼" | Med-High | ⅛"–3/16" | Low |
| Heavy Splatter | 5/16" | Low | ⅜"–½" | Med-High |

Please keep in mind that all factors are inter-related

When ready to spray, the nozzle tip is usually off of the gun until the particulate texture material has reached the nozzle head. After the water has been pumped from the hose, a raw aggregate appears. When mixed particulate texture material appears at the gun head, the pump is turned off and an appropriate tip is attached. It is then a good idea to test for the pattern on either cardboard or a scrap of wall-board. Once the various adjustments have been verified, the worker is free to practice his artistry.

Clean up of the inventive machine is quite easy, the procedure being:

1. Flush out the remaining material from the hopper 24;

2. Continue to run warm water through pump 102 and hose 36 until clean;
3. Disconnect hand gun (FIG. 7) or pole gun (FIG. 6);
4. Disconnect material hose 36 at pump 102;
5. Place a sponge, about twice the size of the hose diameter, in the hose. Connect hose 36 to pump 102;
6. Pump water until sponge has been forced through the hose 36; and
7. Flush water through the relief valve 138 after each spray operation. The relief valve must be kept clean in order to function properly.

Those who are skilled in the art will readily perceive how to modify the invention. Therefore, the appended claims are to be construed to cover all equivalent structures which fall within the true scope and spirit of the invention.

The invention claimed is:

1. A portable applicator machine for applying any selected one of a plurality of known particulate textured surfaces onto walls or ceilings, said machine comprising a cart having a housing mounted on two relatively large rear wheels and front supports, said large wheels having a diameter which is large enough to easily roll up or down stairs, said housing including a hopper for holding said particulate texture material, a spray gun for applying said particulate texture material to said walls or ceilings, first delivery means comprising means for pumping said particulate texture material from said hopper through a variable speed pump driven by a first electric motor for transporting said particulate texture material from said hopper through a hose to said spray gun, second delivery means separate from said first delivery means, said second delivery means comprising compressor means driven by a second and separate electric motor for delivering pressurized air through a separate hose to said spray gun in order to drive said particulate texture material out of said spray gun, at least one nozzle tip orifice to provide a selected diameter through which said particulate texture material is delivered under the urging of said variable speed pump and said pressurized air.

2. The machine of claim 1 wherein said spray gun has an elongated material tube for delivering said particulate texture material, and control means associated with said material tube for controlling the delivery of said particulate material, said control means comprising a handle-controlled valve for enabling or preventing a delivery of said particular texture material, a push button-controlled electrical switch for starting or stopping an operation of said first electric motor, and means for supporting said valve control handle and said push button so that operation of said handle coordinates an opening of a valve and an operation of said electric switch.

3. The machine of claim 2 and means for sealing said electric switch and said push button in order to keep said particulate texture material from contaminating said switch.

4. The machine of claim 1 wherein each of said particulate texture material and said compressed air is driven through an individually associated delivery system, each of said individual delivery systems comprising at least a separate hose and a separate valve, each of said valves being a ball valve, and each individual delivery system having said hose and at least one ball valve with bores having substantially the same internal diameter as said hose to prevent turbulence in the flow through the delivery systems.

5. The machine of claim 1 and a power line individually associated with each of said electric motors so that said machine may be run off of two separately fused electric circuits.

6. The machine of claim 1 and check valve means between said spray gun and an adjacent end of said separate hose to prevent a back flow of said particulate texture material into said separate hose.

7. A machine comprising a portable cart having a housing for receiving and delivering particulate texture material for texturing a wall or ceiling surface with a layer of particulate texture material deposited in a preselected one of several patterns, an air compressor on said cart, a spray head, two separate delivery systems, one of said delivery systems comprising variable speed means driven by a first motor for delivering said particulate texture material through a hose to said spray head with a preselected flow rate, the other of said delivery systems comprising other means driven by a second motor for separately delivering pressurized air through a separate hose to an outlet within said spray head for propelling said particulate texture material away from said spray head, said first and second motors being electrically independent of each other, each of said delivery systems comprising a combination of hoses and valves having internal bores of matched diameters to prevent turbulence in the delivery of said particulate texture material and said compressed air, and means for attaching a selected nozzle having an orifice with a particular diameter to said spray head for delivering said air and particulate texture material away from said spray head and toward said wall and ceiling.

8. A machine comprising a portable cart having a housing for receiving and delivering particulate texture material for texturing a wall or ceiling surface with a layer of particulate texture material deposited in a preselected one of several patterns, an air compressor on said cart, a spray head, two separate delivery systems, means for separately driving each of said delivery systems from differently fused electrical circuits whereby said machine does not draw more current than any one of the fuses can deliver, one of said delivery systems comprising variable speed means driven by a first motor for delivering said particulate texture material through a hose to said spray head with a preselected flow rate, the other of said delivery systems comprising means driven by a second motor for separately delivering pressurized air through a separate hose to an outlet within said spray head for propelling said particulate texture material away from said spray head, each of said delivery systems comprising a combination of hoses and valves having internal bores of matched diameters to prevent turbulence in the delivery of said particulate texture material and said compressed air, means for attaching a selected nozzle having an orifice with a particular diameter to said spray head for delivering said air and particulate texture material away from said spray head and toward said wall and ceiling.

9. The machine of claim 8 wherein said spray head comprises a material tube having a spray head on one end and control means on the other end of said material tube, a separate hose extending from said control means substantially parallel to said material tube to said spray head for conveying said pressurized air to said spray head;

said control means comprising a handle-controlled ball valve for opening or closing a passageway through said material tube in order to control a flow of said particulate texture material through said material tube, an actuator-controlled electrical switch for switching off/on said first motor, and a valve for switching off/on said pressurized air; and bracket means attached to said other end of said material tube, said bracket securing said ball valve and said actuator control so as to be simultaneously controlled by said ball valve handle.

10. The machine of claim 9 and a check valve on an end of said separate hose adjacent said spray head to prevent a back flow of said particulate texture material into said separate hose while enabling a flow of said pressurized air to said spray head.

11. The machine of claim 10 and means on said cart for selecting a speed of said variable speed motor.

12. The machine of claim 11 and large wheels supporting one end of said cart, said large wheels having a diameter which easily rolls up or down stairs, and handles positioned near said large wheels to facilitate pulling said machine up a stair.

13. The machine of claim 12 wherein said means for separately driving said delivery systems comprise two power cords for individually powering said first motor for delivering said particulate texture material and for powering said second motor for delivering pressurized air, whereby said two power cords may be plugged into separately fused house circuits and do not require special high amperage circuits.

14. The machine of claim 13 herein said housing for receiving said particulate texture material is a hopper made of a material which does not rust or corrode.

15. The machine of claim 13 wherein said housing for receiving said particulate texture material is a hopper made of fiberglass.

16. The machine of claim 15 wherein said means for delivering said particulate texture material comprises a rotor member.

* * * * *